US005654263A

United States Patent [19]

Abusleme et al.

[11] Patent Number: 5,654,263

[45] Date of Patent: Aug. 5, 1997

[54] TERNARY MIXTURES OF SOLVENTS AND THEIR USE FOR REMOVING OILY SUBSTANCES

[75] Inventors: Julio A. Abusleme, Saronno; Rossella Silvani, Lentate sul Seveso; Patrizia Maccone, Milan, all of Italy

[73] Assignee: Ausimont S.p.A., Milan, Italy

[21] Appl. No.: 547,331

[22] Filed: Oct. 24, 1995

[30] Foreign Application Priority Data

Nov. 21, 1994 [IT] Italy ..... MI94A2359 U

[51] Int. Cl.[6] ..... C11D 7/28; C11D 7/50

[52] U.S. Cl. ..... 510/365; 510/405; 510/412; 510/415; 510/417

[58] Field of Search ..... 510/365, 405, 510/412, 415

[56] References Cited

U.S. PATENT DOCUMENTS

| | | | |
|---|---|---|---|
| 3,242,218 | 3/1966 | Miller . | |
| 3,715,378 | 2/1973 | Sianesi et al. . | |
| 4,451,646 | 5/1984 | Sianesi et al. . | |
| 5,091,589 | 2/1992 | Meyer et al. . | |
| 5,143,652 | 9/1992 | Slinn . | |
| 5,273,592 | 12/1993 | Li . | |
| 5,428,122 | 6/1995 | Abusleme et al. | 526/209 |

FOREIGN PATENT DOCUMENTS

| | | |
|---|---|---|
| 0148482A2 | 7/1985 | European Pat. Off. . |
| 0154297A2 | 9/1985 | European Pat. Off. . |
| 0244839A2 | 11/1987 | European Pat. Off. . |
| 0337346B1 | 10/1989 | European Pat. Off. . |
| 0445738A2 | 9/1991 | European Pat. Off. . |
| 0575794A1 | 12/1993 | European Pat. Off. . |
| 0625526A1 | 11/1994 | European Pat. Off. . |
| 1104482 | 2/1968 | United Kingdom . |

*Primary Examiner*—Margaret Einsmann

*Attorney, Agent, or Firm*—Watson Cole Stevens Davis, P.L.L.C.

[57] ABSTRACT

Ternary mixtures, particularly suitable for removing oily substances having both an hyrogenated and fluorinated or mixed basis, essentially consisting of: (a) water; (b) terbutanol; (c) a fluoropolyoxyalkylene having hydrogenated end groups and/or hydrogenated repetitive units. Such mixtures have high flash point, are non toxic and with null depleting potential of the ozone and show a ternary diagram characterized by a wide monophasic zone, wherein the three components form limpid and stable solutions.

13 Claims, 1 Drawing Sheet

TERNARY MIXTURES OF SOLVENTS AND THEIR USE FOR REMOVING OILY SUBSTANCES

Figure 1:
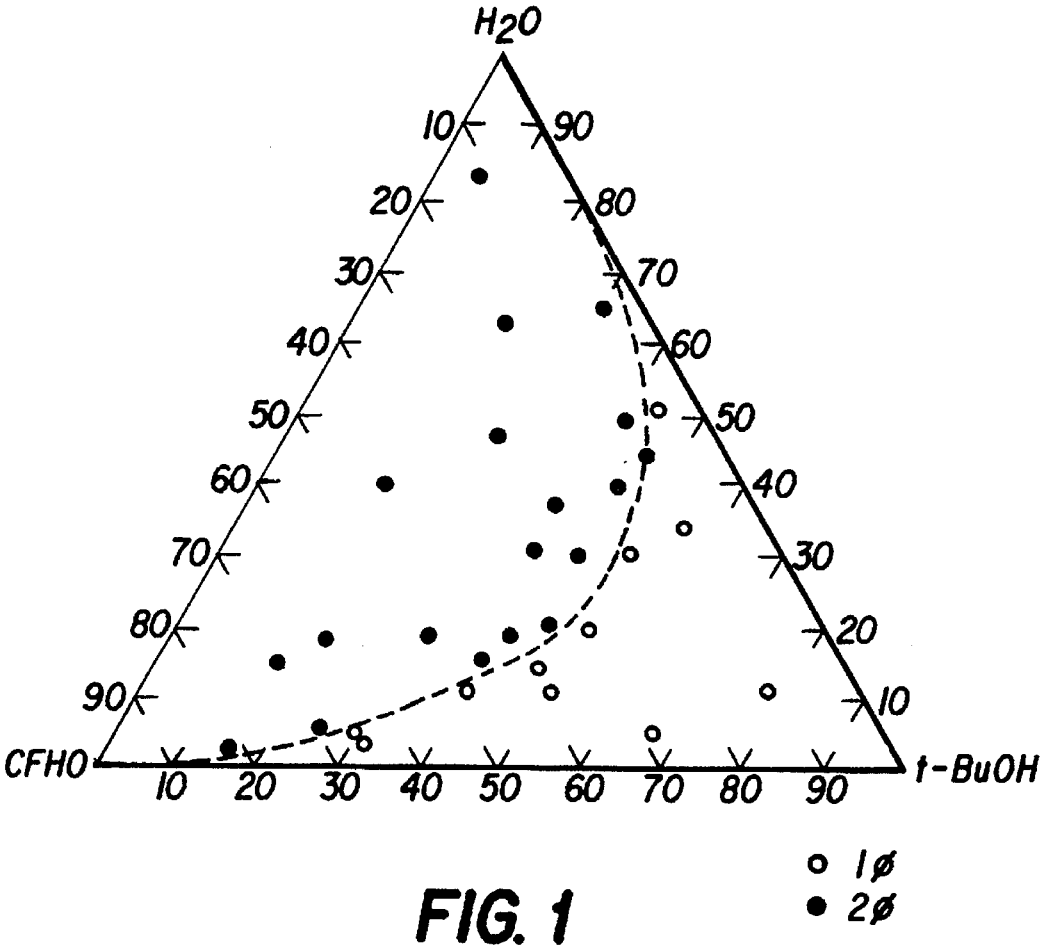

The present invention relates to ternary mixtures of solvents, and to their use for removing oily substances.

Chlorinated solvents, such as methylene chloride or carbon tetrachloride, or chlorofluorocarbons (CFC), in particular CFC-113 (1,1,2-trichlorotrifluoroethane), are commonly used for removing oils, greases, waxes and the like from surfaces of various kind, for instance from metal articles in precision mechanical industry.

As known, such chlorinated solvents are endowed with a high depleting potential towards the ozone present in the stratosphere. For such reason their production and their use will be in a few years restricted or banned as stipulated by some International agreements (Montreal Protocol and subsequent amendments).

Therefore, the research engagement of finding other solvents, or mixtures of solvents, not damaging to the ozone of the stratosphere, non toxic and preferably with low inflammability (high flash point), which supply at the same time performances comparable to or higher than those of the chlorinated solvents above mentioned as regards the cleaning effectiveness towards oils, greases, waxes and the like, having both a mineral and a fluorinated basis.

The solvents, or mixtures of solvents proposed to such purpose are numerous. For instance in EP Patent A-575,794 are described mixtures formed by isopropanol, water, and a fluorinated compound of formula $C_wH_xF_yO_z$, wherein x<y, x+y=2 w+2, z=0 or 1, having boiling point comprised from 40° to 100° C. In such mixtures having a flash point generally higher than 50° C., the amount of isopropanol is by far prevailing, around 70–80% by weight.

Other solvents, or mixtures of solvents, are described in U.S. Pat. Nos. 5,273,592 and 5,143,652.

The Applicant has unexpectedly found that it is possible to obtain mixtures formed by water, terbutanol and a fluoropolyoxyalkylene having hydrogenated end groups and/or hydrogenated repetitive units, as defined hereinafter, which are particularly suitable for removing oily substances, having both an hydrogenated and a fluorinated or mixed basis, with high flash point, non toxic, and with null depleting potential of the ozone.

Object of the present invention are therefore ternary mixtures essentially formed by: (a) water; (b) terbutanol; (c) a fluoropolyoxyalkylene having hydrogenated end groups and/or hydrogenated repetitive units.

A further object of the present invention is a process for removing oil substances from the surface of a substrate, which comprises applying on said surface a ternary mixture as defined above.

The fluoropolyoxyalkylene having hydrogenated end groups and/or hydrogenated repetitive units are known products, already described, for instance, in European patent application No. 94107042.7, filed on May 5, 1994 in the name of the Applicant. They are formed by repetitive units, statistically distributed along the chain, selected from:

$$-CFZO-,\ -CF_2CFZO-,\ -CF_2\underset{\underset{CF_3,}{|}}{C}FO-,\ -\underset{\underset{CF_3}{|}}{C}FO-,$$

$$-CZ_2CF_2CF_2O-,\ -CF_2\underset{\underset{OR_f}{|}}{C}FO-,\ -\underset{\underset{OR_f}{|}}{C}FO-,$$

and by hydrogenated end groups selected from $-CF_2H$, $-CF_2CF_2H$, $-CFH-CF_3$, and $-CFH-OR_f$, wherein $R_f$ is defined as above; or perfluorinated end groups selected from $-CF_3$, $-C_2F_5$, and $-C_3F_7$, being at least one of the end groups hydrogenated.

The number average molecular weight is such that the boiling range, at the presure of 1 atm, is generally comprised from 10° to 150° C., preferably from 30° to 90° C., while the amount of hydrogenated end groups and/or hydrogenated repetitive units is such that the hydrogen content is generally higher than 100 ppm, preferably higher than 2000 ppm.

In particular, fluoropolyoxyalkylenes containing hydrogen can be selected from the following classes:

$$T_1-O(CF_2-\underset{\underset{CF_3}{|}}{C}FO)_a(CFXO)_b-T_2 \qquad (a)$$

wherein:

$T_1$ and $T_2$, equal to or different from each other, are hydrogenated groups $-CF_2H$, $-CFH-CF_3$, or perfluorinated groups $-CF_3$, $-C_2F_5$, $-C_3F_7$, at least one of the end groups being hydrogenated; X is —F or $-CF_3$; a; b are integers so that the boiling temperature is comprised in the range indicated above, a/b is comprised from 5 to 15;

$$T_3-O(CF_2CF_2O)_c(CF_2O)_d-T_4 \qquad (b)$$

wherein:

$T_3$ and $T_4$, equal to or different from each other, are hydrogenated groups $-CF_2H$ or $-CF_2-CF_2H$, or perfluorinated groups $-CF_3$, $-C_2F_5$, at least one of the end groups being hydrogenated; c, d are integers so that the boiling temperature is comprised in the range indicated above, c/d is comprised from 0.3 to 5;

$$T_5-O(CF_2-\underset{\underset{CF_3}{|}}{C}FO)_e(CF_2CF_2O)_f(CFXO)_g-T_6 \qquad (c)$$

wherein:

$T_5$ and $T_6$, equal to or different from each other, are hydrogenated groups $-CF_2H$, $-CF_2-CF_2H$, or $CFH-CF_3$, or perfluorinated groups $-CF_3$, $-C_2F_5$, $C_3F_7$, at least one of the end groups being hydrogenated; X is —F or $-CF_3$; e, f, g are such numbers that the boiling temperature is comprised in the range indicated above, e/(f+g) is comprised from 1 to 10, f/g is comprised from 1 to 10;

$$T_7-O(CF_2-\underset{\underset{CF_3}{|}}{C}FO)_h-T_8 \qquad (d)$$

wherein:

$T_7$ and $T_8$, are hydrogenated groups $-CFH-CF_3$ or perfluorinated groups $-C_2F_5$, $C_3F_7$, at least one of the end groups being hydrogenated; h is such a number that the boiling temperature is comprised in the range indicated above;

$$T_9-O(CZ_2CF_2CF_2O)_i-T_{10} \qquad (e)$$

wherein:

$Z_2$ is F or H; $T_9$ and $T_{10}$, equal to or different from each other, are $-CF_2H$ or $-CF_2-CF_2H$ groups, or perfluorinated groups $-CF_3$, $-C_2F_5$, $-C_3F_7$; at least one of the end groups being hydrogenated; i is such a number that the boiling temperature is comprised in the range indicated above;

$$T_{11}-O(CF_2O)_j(CF_2\underset{\underset{OR_f}{|}}{C}FO)_k(\underset{\underset{OR_f}{|}}{C}FO)_l-T_{12} \quad (f)$$

wherein:

$R_f$ is $-CF_3$, $-C_2F_5$, or $-C_3F_7$; $T_{11}$ and $T_{12}$, equal to or different from each other, are groups $-CF_2H$, $-CF_2CF_2H$, $-CFH-OR_f$, or perfluorinated groups $-CF_3$, $-C_2F_5$, $-C_3F_7$, at least one of the end groups being hydrogenated; j, k, l are such numbers that the boiling temperture is comprised in the range indicated above, k+l and j+k+l are at least equal to 2, k/(j+l) is comprised from $10^{-2}$ to $10^3$, l/j is comprised frpm $10^{-2}$ to $10^2$;

$$T_{13}-O(CF_2-\underset{\underset{CF_3}{|}}{C}FO)_m(CFXO)_n(CFHO)_o(CF_2CFHO)_p-T_{14} \quad (g)$$

wherein:

$T_{13}$ and $T_{14}$, equal to or different from each other, are hydrogenated groups $-CF_2H$, $-CFH-CF_3$, or perfluorinated groups $-CF_3$, $-C_2F_5$, $-C_3F_7$, at least one of the end groups being hydrogenated; X is —F or $-CF_3$; m, n, o, p are such numbers that the boiling temperature is comprised in the range indicated above, m/n is comprised from 5 to 40, m/(o+p) is comprised from 2 to 50, o+p is at least 3 or is lower than p;

$$T_{15}-O(CF_2CF_2O)_q(CF_2O)_r(CFHO)_s(CF_2CFHO)_t-T_{16} \quad (h)$$

wherein:

$T_{15}$ and $T_{16}$, equal to or different from each other, are hydrogenated groups $-CF_2H$, $-CF_2-CF_2H$, or perfluorinated groups $-CF_3$, $-C_2F_5$, at least one of the end groups being hydrogenated; q, r, s, t are such numbers that the boiling temperature is comprised in the range indicated above, q/r is comprised from 0.5 to 2, (q+r)/(s+t) is comprised from 3 to 40, s+t is at least 3, s is lower than t;

$$T_{17}-O(CF_2-\underset{\underset{CF_3}{|}}{C}FO)_u(CF_2CF_2O)_v(CFXO)_w(CFHO)_x(CF_2CFHO)_y-T_{18} \quad (i)$$

wherein:

$T_{17}$ and $T_{18}$, equal to or different from each other, are hydrogenated groups $-CF_2H$, $-CF_2CF_2H$, CFH—$CF_3$, or perfluorinated groups $-CF_3$, $-C_2F_5$, $-C_3F_7$, at least one of the end groups being hydrogenated; X is —F or $-CF_3$; u, v, w, x, y are such numbers that the boiling temperature is comprised in the range indicated above, (u+v)/w is comprised from 5 to 40, (u+v)/(x+y) is comprised from 2 to 50, x+y is at least 3, x is lower than y;

They are products obtainable by hydrolysis and subsequent decarboxylation of the —COF groups present in the corresponding perfluoropolyoxyalkylenes, as described for instance in EP patents 154,297, U.S. Pat. Nos. 4,451,646 and 5,091,589.

The starting perfluoropolyoxyalkylenes containing —COF groups as end groups and/or along the chain are described, for instance, in patents GB 1,104,482, (class (a)), U.S. Pat. No. 3,715,378 (class (b)), U.S. Pat. No. 3,242,218 (classes (c) and (d)), EP 148,482 (class (e)), EP 445,738 (class (f)), EP 244,839 and EP 337,346 (classes (g), (h), (i)).

For the purpose of the present invention, monophasic mixtures are particularly preferred, i.e., those wherein the three components indefinitely form a limpid and stable solution. The breath of the existence zone of such monophase can vary even considerably as the type used of fluoropolyoxyalkylene varies, depending particularly on the boiling temperature and on the hydrogen content. It results impossible, therefore, to give composition ranges for the monophasic zone having general validity. In any case, it is sufficient for the skilled to carry out some mixing tests of the three components to locate the monophase existence zone.

For guidance only, the following general criteria can be indicated: (i) when the amount of terbutanol is higher than 30% by weight, the other two components can range within the whole range of composition, i.e., practically from 0.1 to 69.9% by weight; (ii) when the amount of terbutanol is lower than 30% by weight, the amount of fluoropolyoxyalkylene containing hydrogen is preferably lower than 10% by weight, or, alternatively, the amount of water is preferably lower than 20% by weight.

Among the ternary mixtures of the present invention, are particularly suitable for removing fluorinatd oily substances those essentially formed by:

(a) from 0.1 to 30% by weight of water;

(b) from 0.1 to 60% by weight of terbutanol;

(c) from 20 to 99.8% by weight of a fluoropolyoxyalkylene having hydrogenated end groups and/or hydrogenated repeating units.

On the contrary, mixtures particularly suitable for removing non fluorinated oil substances are those formed essentially by:

(a) from 0.1 to 79.9% by weight of water;

(b) from 20 to 80% by weight of terbutanol;

(c) from 0.1 to 20% by weight of a fluoropolyoxyalkylene having hydrogenated end groups and/or hydrogenated repetitive units.

Figure 2:
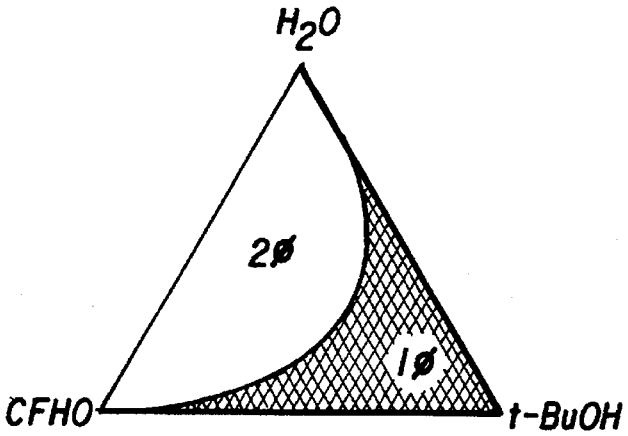

In FIGS. 1 and 2 two representations of the ternary diagram related to the mixtures object of the present invention are reported, obtained with experiments by mixing, at the temperature of 23° C., the three components in different ratios and checking the existence of only one phase (1ø) or of two phases (2ø). For the representation of such diagram fluoropolyoxyalkylene was employed containing hydrogen of Example 1 (generically indicated as CFHO in the Figures).

The ternary mixtures object of the present invention can be employed for cleaning sublayers surfaces both of inorganic and organic type, such as, metals, ceramic or glass materials, polymeric substrates, etc. The characteristics making the mixtures of the present invention particularly suitable to such purpose are, in short, the following:

(a) versatility since they result effective on various types of oils, greases, waxes and the like, having both an hydrogenated and a fluorinated or mixed basis;

(b) existence of a wide monophasic zone (1ø of FIG. 1), wherein the three components form limpid and stable solutions;

(c) null toxicity;

(d) null depleting potential of the ozone (Ozone Depleting Potential, ODP);

(e) many of them have high flash point mainly depending from the type of fluoropolyoxyalkylene;

(f) recovery easiness, since many of the oil products commonly used for lubrication, and in particular greases, are removed without dissolving, wherefore they can be separated from the mixture of solvents by means of common mechanical means (for instance by separation or by filtration), without having to resort to more complex and expensive separation processes (for instance distillation).

By hydrogen-based oils and greases, products are meant based on mineral oils derived from petroleum, or on synthetic, semi-synthetic and emulsifiable non fluorinated oils. By oils and greases having a fluorinated basis we essentially mean the lubricants based on perfluoropolyoxyalkylenes, commercially known as Fomblin®, Krytox®, Demnum®, etc.

The removal of the oil products can be carried out according to known techniques. For instance after having mechanically removed most of the oil and grease, the piece to be cleaned is immersed into the ternary mixture object of the present invention, or the mixture is spray-applied or by means of buffers. In case of immersion, the contact betwen the mixture and surface to be cleaned can be favoured utilizing an ultrasonic bath which allows to remove more effectively also solid polluting agents, particularly when irregular surfaces must be cleaned. After cleaning, the treated article is dried, at air or in stove at a temperature generally comprised from 40° to 140° C., preferably from 70° to 110° C.

The present invention will be now further illustrated from the following working examples, which cannot be in any way limitative for the scope of the invention itself.

EXAMPLES 1–5

Five monophasic mixtures $H_2O$/terbutanol (t-BuOH)/fluoropolyoxyalkylene containing hydrogen having the compositions reported in Table 1 were prepared. As fluoropolyoxyalkylene it was employed a product of formula:

$$CFH—O(CF_2CF_2O)_{m5}(CF_2O)_{n5}—CF_2H$$

having boiling range from 30° to 130° C., weight average molecular weight $M_w$=316, $m_5/n_5$ ratio=1.03 (determined by $^{19}$F-NMR analysis), content in hydrogen equal to 6260 ppm (determined by $^1$H-NMR analysis).

The capability of the mixtures of removing oily products (de-oiling) was verified according to the following method. A drop of the oily product is deposited on the bottom of a glass crystallization vessel and the mixture in question is slowly added letting it flow along the vessel walls. The behaviour of the oil drop is observed: if this completely separates from the bottom without dissolving or completely dissolves, the test is to be considered as passed. If, on the contrary, the drop remains anchored to the bottom, or it only partially comes out and/or dissolves, the test is negative.

The de-oiling tests were carried out with the following lubricating oils:

- FINA® IT 11/012A oil (mixture of hydrocarbons derived from petroleum);
- LEYBOLD® N62 oil (mineral oil utilized in vacuum systems);
- ESSO UNIVOLT® P 60 oil (refined mineral oil utilized as dielectric fluid for transformers).

The results are reported in Table 1. The positive tests were distinguished between those wherein solubilization of oil (+) was noticed and those wherein separation occurred without solubilization (++).

On the mixtures of Examples 3 and 5 the flash point was also measured, according to ASTM D-56/87 standard (by a Flash TAG Close Tester).

EXAMPLES 6–7 (Comparative)

For comparative purposes, two monophasic mixtures $H_2O$/isopropanol (i-PrOH)/hydrogenated fluoropolyoxyalkylene, having the compositions reported in Table 1, were prepared. The hydrogenated fluoropolyoxyalkylene is the same as in Examples 1–5. With such mixtures de-oiling tests were carried out as described above. The results are reported in Table 1.

EXAMPLES 8–10 (Comparative)

For comparative purposes, de-oiling tests were carried out as described above with the following fluids:

- the hydrogenated fluoropolyoxyalkylene of Examples 1–5 (Example 8);
- a perfluoropolyoxyalkylene Galden® Y, having formula:

$$CF_3—(OCF(CF_3)CF_2)_{n4}(OCF_2)_{m4}—OCF_3$$

having $n_4/m_4$=40 and boiling range between 60° and 80° C. (Example 9);

- a mixture formed by 67% by weight of $H_2O$ and 33% by weight of t-BuOH (Example 10).

The results are reported in Table 1.

TABLE 1

| EX. | COMPOSITION (% by weight) | | FLASH POINT (°C.) | DE-OILING oil FINA(R) | oil LEYBOLD(R) | oil ESSO(R) |
|---|---|---|---|---|---|---|
| 1 | $H_2O$ | 20 | — | (+) | (++) | (++) |
| | t-BuOH | 60 | | | | |
| | CFHO | 20 | | | | |
| 2 | $H_2O$ | 40 | — | (+) | (++) | (++) |
| | t-BuOH | 50 | | | | |
| | CFHO | 10 | | | | |
| 3 | $H_2O$ | 50 | 18.5 | (++) | (++) | (++) |
| | t-BuOH | 45 | | | | |
| | CFHO | 5 | | | | |
| 4 | $H_2O$ | 10 | — | (+) | (++) | (++) |
| | t-BuOH | 40 | | | | |
| | CFHO | 50 | | | | |
| 5 | $H_2O$ | 3 | >78 | (+) | (++) | (++) |
| | t-BuOH | 30 | | | | |
| | CFHO | 67 | | | | |
| 6(*) | $H_2O$ | 5 | — | (+) | (–) | (–) |
| | i-PrOH | 45 | | | | |
| | CFHO | 50 | | | | |
| 7(*) | $H_2O$ | 10 | — | (+) | (–) | (–) |
| | i-PrOH | 80 | | | | |
| | CFHO | 10 | | | | |
| 8(*) | CFHO | 100 | — | (–) | (–) | (–) |
| 9(*) | Galden(R)Y | 100 | — | (–) | (–) | (–) |
| 10(*) | $H_2O$ | 67 | — | (+) | (–) | (–) |
| | t-BuOH | 33 | | | | |

(*)comparative
(+) removal with solublization
(++) removel without solubilization
(–) poor or null removal

EXAMPLE 11

The mixture of Example 5 was used to verify the capability of removing both mineral and fluorinated greases, according to the following method.

A known amount of grease is uniformly spread on three metal plates (AISI 316 steel). The plates are then weighed on analytical balance and subsequently put into contact with the mixture in question in an ultrasonic bath. After 10 minutes of immersion the plates are dried in stove at 120° C. for 2 hours, so as to completely remove solvents, and then weighed again. The test result is expressed as percentage of removed grease. The test conditions are the following:

temperature: 60° C.; grease amount: 0.5 g; mixture amount: 150 ml; ultrasonic bath power: 30 Watt. The greases employed are the following:

mineral grease FIAT TUTELA® MR2 (oil/lithium soap);

fluorinated grease FOMBLIN® RT15 (Fomblin®/polytetrafluoroethylene).

The results are reported in Table 2.

EXAMPLES 12–13 (Comparative)

The same tests of greases removal of Example 11 were repeated with the following fluids:

the perfluoropolyoxyalkylene Galden® Y of Example 9 (Example 12);

1,1,2-trichlorotrifluoroethane (CFC-113) (Example 13).

The results are reported in Table 2.

As it can be noted by comparing the results of Example 11 with those of Examples 12–13, the mixtures of the present invention allow to remove both hydrogenated and fluorinated greases, with an effectiveness comparable with that of CFC-113. Moreover, the mixtures of the present invention show the advantage of removing the grease without dissolving the oil composition thereof, wherefore the mixture can be recovered by simple filtration. With other fluids, the basic oil of the grease passes into the solution, while the thickening agent partly precipitates and partly remains in suspension; the obtained solution results therefore cloudy and of difficult filtration.

TABLE 2

| Ex. | COMPOSITION (% by weight) | | BOILING TEMP. (°C.) | REMOVAL (% by weight) mineral grease | fluorinated grease |
|---|---|---|---|---|---|
| 11 | $H_2O$ | 3 | | | §§ 80.0 |
| | t-BuOH | 30 | 69 | §§ 98.0 | |
| | CFHO | 67 | | | §§ 100.0 (*) |
| 12(*) | Galden(R)Y | 100 | 70 | 1.0 | § 98.4 |
| 13(*) | CFC-113 | 100 | 47 | § 100 | § 99.1 |

(*)comparative
(§) with solubilization of the basic oil
(§§) without solubilization of the basic oil
(*) after 15 min

We claim:

1. Ternary mixtures consisting essentially of:

(a) from 0.1 to 30% by weight of water;

(b) from 0.1 to 60% by weight of terbutanol; and (c) from 20 to 99.8% by weight of a fluoropolyoxyalkylene having hydrogenated end groups or hydrogenated repetitive units or mixtures thereof.

2. Ternary mixtures according to claim 1, wherein the three components form a single stable phase.

3. Ternary mixtures according to claim 1, wherein the fluoropolyoxyalkylene is formed by repetitive units, statistically distributed along the chin, selected from the group consisting of:

$$-CFZO-,\ -CF_2CFZO-,\ -CF_2\underset{\underset{CF_3}{|}}{C}FO-,\ -\underset{\underset{CF_3}{|}}{C}FO-,$$

$$-CZ_2CF_2CF_2O-,\ -CF_2\underset{\underset{OR_f}{|}}{C}FO-,\ \text{and}\ -\underset{\underset{OR_f}{|}}{C}FO-,$$

wherein

Z is —H or —F, $R_f$ is $-CF_3$, $-C_2F_5$, or $-C_3F_7$, and by hydrogenated end groups selected from the group consisting of $-CF_2H$, $-CF_2CF_2H$, $-CFH-CF_3$, and $-CFH-OR_f$ and wherein $R_f$ is defined above, or by perfluorinated end groups selected from the group consisting of $-CF_3$, $-C_2F_5$, and $-C_3F_7$, at least one of the end groups being hydrogenated.

4. Ternary mixtures according to claim 3, wherein the fluoropolyoxyalkylene has a weight average molecular weight such that the boiling range, at the pressure of 1 atm, is about from 10° to 150° C., the amount of hydrogenated end groups, or hydrogenated repetitive units or mixtures thereof being such that the hydrogen content is greater than 100 ppm.

5. Ternary mixtures according to claim 4, wherein the hydrogen content is greater than 2000 ppm.

6. Ternary mixtures according to claims 4 or 5, wherein the fluoropolyoxyalkylene is selected from the following classes consisting of:

$$T_1-O(CF_2-\underset{\underset{CF_3}{|}}{C}FO)_a(CFXO)_b-T_2 \qquad (a)$$

wherein:

$T_1$ and $T_2$, equal to or different from each other, are hydrogenated groups $-CF_2H$, $-CFH-CF_3$, or perfluorinated groups $-CF_3$, $-C_2F_5$, $-C_3F_7$, at least one of the end groups being hydrogenated; X is —F or $-CF_3$; a, b are such numbers that, the boiling temperature is within the range indicated above, a/b is about from 5 to 15;

$$T_3-O\ (CF_2CF_2O)_c(CF_2O)_d-T_4 \qquad (b)$$

wherein:

$T_3$ and $T_4$, equal to or different from each other, are hydrogenated groups $-CF_2H$ or $-CF_2-CF_2H$, or perfluorinated groups $-CF_3$, $-C_2F_5$, at least one of the end groups being hydrogenated; c, d are such numbers that the boiling temperature is within the range indicated above, c/d is about from 0.3 to 5;

$$T_5-O(CF_2-\underset{\underset{CF_3}{|}}{C}FO)_e(CF_2CF_2O)_f(CFXO)_g-T_6 \qquad (c)$$

wherein:

$T_5$ and $T_6$, equal to or different from each other, are hydrogenated groups $-CF_2H$, $-CF_2CF_2H$, or $CFH-CF_3$, or perfluorinated groups $-CF_3$, $-C_2F_5$, $C_3F_7$, at least one of the end groups being hydrogenated; X is —F or $-CF_3$;

e, f, g are such numbers that the boiling temperature is within the range indicated above, e/(f+g) is about from 1 to 10, f/g is about from 1 to 10;

$$T_7-O(CF_2-\underset{\underset{CF_3}{|}}{C}FO)_h-T_8 \qquad (d)$$

wherein:

$T_7$ and $T_8$, are hydrogenated groups $-CFH-CF_3$ or perfluorinated groups $-C_2F_5$, $C_3F_7$, at least one of the end groups being hydrogenated; h is such a number that the boiling temperature is within the range indicated above;

$$T_9-O(CZ_2CF_2CF_2O)_i-T_{10} \qquad (e)$$

wherein:

$Z_2$ is —F or -H; $T_9$ and $T_{10}$, equal to or different from each other, are —$CF_2H$ or —$CF_2$—$CF_2H$ groups, or perfluorinated groups —$CF_3$, —$C_2F_5$, $C_3F_7$, at least one of the end groups being hydrogenated; i is such a number that the boiling temperature is within the range indicated above;

$$T_{11}-O(CF_2O)_j(CF_2\underset{\underset{OR_f}{|}}{C}FO)_k(\underset{\underset{OR_f}{|}}{C}FO)_l-T_{12} \quad (f)$$

wherein:

$R_f$ is —$CF_3$, —$C_2F_5$, or —$C_3F_7$; $T_{11}$ and $T_{12}$, equal to or different from each other, are groups —$CF_2H$, —$CF_2CF_2H$, —CFH—$OR_f$, or perfluorinated groups —$CF_3$, —$C_2F_5$, —$C_3F_7$, at least one of the end groups being hydrogenated; j, k, l are such numbers that the boiling temperture is within the range indicated above, k+l and j+k+l are at least equal to 2, k/(j+l) is about from $10^{-2}$ to $10^3$; l/j is about from $10^{-2}$ to $10^2$;

$$T_{13}-O(CF_2-\underset{\underset{CF_3}{|}}{C}FO)_m(CFXO)_n(CFHO)_o(CF_2CFHO)_p-T_{14} \quad (g)$$

wherein:

$T_{13}$ and $T_{14}$, equal to or different from each other, are hydrogenated groups —$CF_2H$, —CFH—$CF_3$, or perfluorinated groups —$CF_3$, —$C_2F_5$, —$C_3F_7$, at least one of the end groups being hydrogenated; X is —F or —$CF_3$; m, n, o, p are such numbers that the boiling temperature is within the range indicated above, m/n is about from 5 to 40, m/(o+p) is about from 2 to 50, o+p is at least 3 or is lower than p;

$$T_{15}-O(CF_2CF_2O)_q(CF_2O)_r(CFHO)_s(CF_2CFHO)_t-T_{16} \quad (h)$$

wherein:

$T_{15}$ and $T_{16}$, equal to or different from each other, are hydrogenated groups —$CF_2H$, —$CF_2$—$CF_2H$, or perfluorinated groups —$CF_3$, —$C_2F_5$, at least one of the end groups being hydrogenated; q, r, s, t are such numbers that the boiling temperature is within the range indicated above, q/r is about from 0.5 to 2, (q+r)/(s+t) is about from 3 to 40, s+t is at least 3, s is lower than t; and $$T_{17}-O(CF_2-\underset{\underset{CF_3}{|}}{C}FO)_u(CF_2CF_2O)_v(CFXO)_w(CFHO)_x(CF_2CFHO)_y-T_{18} \quad (i)$$

wherein:

$T_{17}$ and $T_{18}$, equal to or different from each other, are hydrogenated groups —$CF_2H$, —$CF_2CF_2H$, —CFH—$CF_3$, or perfluorinated groups —$CF_3$, —$C_2F_5$, —$C_3F_7$, at least one of the end groups being hydrogenated; X is —F or —$CF_3$; u, v, w, x, y are such numbers that the boiling temperature is within the range indicated above, (u+v)/w is about from 5 to 40, (u+v)/(x+y) is about from 2 to 50, x+y is at least 3, x is lower than y.

7. A process for removing oily substances from a substrate which comprises contacting said oily substances with a ternary mixture consisting essentially of:

(a) water;

(b) terbutanol; and (c) a fluoropolyoxyalkylene having hydrogenated end groups or hydrogenated repetitive units or a mixture thereof, and then removing said ternary mixture from the substrate.

8. Ternary mixtures consisting essentially of:

(a) from 0.1 to 75% by weight of water;

(b) from 20 to 80% by weight of terbutanol; and (c) from 0.1 to 20% by weight of a fluoropolyoxyalkylene having hydrogenated end groups or hydrogenated repetitive units or mixtures thereof.

9. Ternary mixtures according to claim 8, wherein components (a), (b), and (c) form a single stable phase.

10. Ternary mixtures according to claim 8, wherein the fluoropolyoxyalkylene is formed by repetitive units, statistically distributed along the chain, selected from the group consisting of:

$$-CFZO-,\ CF_2CFZO-,\ -CF_2\underset{\underset{CF_3,}{|}}{C}FO-,\ -\underset{\underset{CF_3}{|}}{C}FO-,$$

$$-CZ_2CF_2CF_2O-,\ CF_2\underset{\underset{OR_f}{|}}{C}FO-,\ \text{and}\ -\underset{\underset{OR_f}{|}}{C}FO-,$$

wherein

Z is —H or —F, $R_f$ is —$CF_3$, —$C_2F_5$, or —$C_3F_7$ and by hydrogenated end groups selected from the group consisting of —$CF_2H$, —$CF_2CF_2H$, —CFH—$CF_3$, and —CFH—$OR_f$, wherein $R_f$ is defined as above, or by perfluorinated end groups selected from the group consisting of —$CF_3$, —$C_2F_5$, and —$C_3F_7$, at least one of the end groups being hydrogenated.

11. Ternary mixtures according to claim 10, wherein the fluoropolyoxyalkylene has a weight average molecular weight such that the boiling range, at the pressure of 1 atm, is about from 10° to 150° C., the amount of hydrogenated end groups or hydrogenated repetitive units or mixtures thereof being such that the hydrogen content is greater than 100 ppm.

12. Ternary mixtures according to claim 11, wherein the hydrogen content is greater than 2000 ppm.

13. Ternary mixtures according to claim 12, wherein the fluoropolyoxyalkylene is selected from the following classes:

$$T_1-O(CF_2-\underset{\underset{CF_3}{|}}{C}FO)_a(CFXO)_b-T_2 \quad (a)$$

wherein:

$T_1$ and $T_2$, equal to or different from each other, are hydrogenated groups —$CF_2H$, —CFH—$CF_3$, or perfluorinated groups —$CF_3$, —$C_2F_5$, —$C_3F_7$, at least one of the end groups being hydrogenated; X is —F or —$CF_3$; a, b are such numbers that the boiling temperature is within the range indicated above, a/b is about from 5 to 15;

$$T_3-O(CF_2CF_2O)_c(CF_2O)_d-T_4 \quad (b)$$

wherein:

$T_3$ and $T_4$, equal to or different from each other, are hydrogenated groups —$CF_2H$ or —$CF_2CF_2H$, or perfluorinated groups —$CF_3$, —$C_2F_5$, at least one of the end groups being hydrogenated; c, d are such numbers that the boiling temperature is within the range indicated above, c/d is about from 0.3 to 5;

$$T_5-O(CF_2-\underset{\underset{CF_3}{|}}{CFO})_e(CF_2CF_2O)_f(CFXO)_g-T_6 \quad (c)$$

wherein:

$T_5$ and $T_6$, equal to or different from each other, are hydrogenated groups $-CF_2H$, $-CF_2CF_2H$, or $CFH-CF_3$, or perfluorinated groups $-CF_3$, $-C_2F_5$, $-C_3F_7$, at least one of the end groups being hydrogenated; x is —F or $-CF_3$; e, f, g are such numbers that the boiling temperature is within the range indicated above, e/(f+g) is about from 1 to 10, f/g is about from 1 to 10;

$$T_7-O(CF_2-\underset{\underset{CF_3}{|}}{CFO})_h-T_8 \quad (d)$$

wherein:

$T_7$ and $T_8$, are hydrogenated groups $-CFH-CF_3$ or perfluorinated groups $-C_2F_5$, $-C_3F_7$, at least one of the end groups being hydrogenated; h is such a number that the boiling temperature is within the range indicated above;

$$T_9-O(CZ_2CF_2CF_2O)_i-T_{10} \quad (e)$$

wherein:

$Z_2$ is —F or —H; $T_9$ and $T_{10}$, equal to or different from each other, are $-CF_2H$ or $-CF_2-CF_2H$ groups, or perfluorinated groups $-CF_3$, $C_2F_5$, $C_3F_7$, at least one of the end groups being hydrogenated; i is such a number that the boiling temperature is within the range indicated above;

$$T_{11}-O(CF_2O)_j(CF_2\underset{\underset{OR_f}{|}}{CFO})_k(\underset{\underset{OR_f}{|}}{CFO})_l-T_{12} \quad (f)$$

wherein $R_f$ is $-CF_3$, $-C_2F_5$or $-C_3F_7$; $T_{11}$ and $T_{12}$, equal to or different from each other, are groups $-CF_2H$, $-CF_2CF_2H$, $-CFH-OR_f$, or perfluorinated groups $-CF_3$, $-C_2F_5$, $-C_3F_7$, at least one of the end groups being hydrogenated; j, k, l are such numbers that the boiling temperature is within the range indicated above, k+l and j+k+l are at least equal to 2, k/(j+l) is about from $10^{-2}$ to $10^3$; l/j is about from $10^{-2}$ to $10^2$;

$$T_{13}-O(CF_2-\underset{\underset{CF_3}{|}}{CFO})_m(CFXO)_n(CFHO)_o(CF_2CFHO)_p-T_{14} \quad (g)$$

wherein:

$T_{13}$ and $T_{14}$, equal to or different from each other, are hydrogenated groups $-CF_2H$, $-CFH-CF_3$, or perfluorinated groups $-CF_3$, $-C_2F_5$, $-C_3F_7$, at least one of the end groups being hydrogenated; x is —F or $-CF_3$; m, n, o, p are such numbers that the boiling temperature is within the range indicated above, m/n is about from 5 to 40, m/(o+p) is about from 2 to 50, o+p is at least 3 or is lower than p;

$$T_{15}-O(CF_2CF_2O)_q(CF_2O)_r(CFHO)_s(CF_2CFHO)_t-T_{16} \quad (h)$$

wherein:

$T_{15}$ and $T_{16}$, equal to or different from each other, are hydrogenated groups $-CF_2H$, $-CF_2-CF_2H$, or perfluorinated groups $-CF_3$, $-C_2F_5$, at least one of the end groups being hydrogenated; q, r, s, t are such numbers that the boiling temperature is within the range indicated above, q/r is about from 0.5 to 2, (q+r)/(s+t) is about from 3 to 40, s+t is at least 3, s is lower than t; and $$T_{17}-O(CF_2-\underset{\underset{CF_3}{|}}{CFO})_u(CF_2CF_2O)_v(CFXO)_w(CFHO)_x(CF_2CFHO)_y-T_{18} \quad (i)$$

wherein:

$T_{17}$ and $T_{18}$, equal to or different from each other, are hydrogenated groups $-CF_2H$, $-CF_2CF_2H$, $-CFH-CF_3$, or perfluorinated groups $-CF_3$, $-C_2F_5$, $-C_3F_7$, at least one of the end groups being hydrogenated; x is —F or $-CF_3$; u, v, w, x, y are such numbers that the boiling temperature is within the range indicated above, (u+v)/w is about from 5 to 40, (u+v)/(x+y) is about from 2 to 50, x+y is at least 3, x is lower than y.

* * * * *